United States Patent [19]

Zapolsky

[11] 3,974,373

[45] Aug. 10, 1976

[54] LAMP FIXTURE

[76] Inventor: Ira M. Zapolsky, 145-16 Newport Ave., Neponsit, N.Y. 11694

[22] Filed: July 21, 1975

[21] Appl. No.: 597,494

[52] U.S. Cl. ..... 240/128

[51] Int. Cl.[2] ..... F21V 17/06

[58] Field of Search ..... 240/128, 135, 139, 143, 240/144, 146, 148–150

[56] References Cited

UNITED STATES PATENTS

| | | | |
|---|---|---|---|
| 570,669 | 11/1896 | Lapworth | 240/143 |
| 2,728,850 | 12/1955 | De Sherbinin | 240/144 X |

FOREIGN PATENTS OR APPLICATIONS

| | | | |
|---|---|---|---|
| 256,987 | 1/1967 | Austria | 240/128 |
| 647,246 | 11/1928 | France | 240/143 |
| 1,257,891 | 4/1959 | France | 240/128 |
| 480,678 | 4/1927 | Germany | 240/128 |

*Primary Examiner*—George H. Miller, Jr.
*Attorney, Agent, or Firm*—Friedman & Goodman

[57] ABSTRACT

A lamp fixture for releasably holding a hollow globe is comprised of a sheet metal housing that is generally cup shaped and to the base wall of which is removably secured a pair of diametrically opposed resilient clip members for holding the globe. The clip members may be secured on any one of a plurality of different diameters depending upon the specific dimension of the diameter of the globe that is to be held.

9 Claims, 7 Drawing Figures

LAMP FIXTURE

BACKGROUND OF THE INVENTION

This invention relates generally to lamp fixtures and more particularly to a single fixture that is adapted to support dimensionally different diameter globes.

One common form of the prior art in the general class to which the present invention is directed provides a fixture to which is secured a globe by means of a plurality of screws that extend radially through the side wall of the fixture and into engagement with a peripheral lip of the globe. It will be appreciated that for a given size prior art fixture, a globe of only a single specific diameter can be accommodated. As will also be appreciated, this form of prior art presents several other defects. That is, the screws which retain the globe can become "frozen" and thereby make their removal extremely difficult, particularly when it is considered that the fixture frequently is on a ceiling and is both difficult and awkward to reach. In addition, the screws can be overtightened thereby cracking the globe which is frequently made of glass or other brittle material and thus will entail some additional expense as well as inconvenience to the user. Furthermore, retailers are required to stock lamp fixtures for each size of globe, thereby requiring a large inventory.

SUMMARY OF THE INVENTION

The present invention, as will be described more fully hereinafter, overcomes the shortcomings of the prior art mentioned above, and, in addition, also permits more than one size globe to be used with a single size fixture. The lamp fixture comprising the present invention may be mounted on either a ceiling or a wall. It is comprised of a generally cup-shaped, sheet metal housing. The fixture further includes a pair of diametrically opposed resilient clip means which are secured to the base wall of the housing on either one of at least two different diameters having different dimensions. Thus, when a relatively small globe, for example a 6 inch diameter globe is to be mounted, the resilient spring clips are positioned diametrically opposed to each other on the smaller of the two different diameters. When a relatively large globe, for example an 8 inch globe is to be mounted on the same fixture, the resilient spring clips are mounted diametrically opposed to each other on the larger other diameter that defines an alternative location. The smaller globe, which rests on the base wall of the housing, is urged into contact with a portion of the side wall of the housing by means of a portion of one of the legs of each of the spring clips. When the alternative location of the spring clips is used, the globe will again be urged into contact with the peripheral side wall of the housing by means of one of the legs of the spring clips but the base of the globe will be spaced from the base wall of the housing in order to provide clearance for the screws that secure the housing to either the ceiling or to the wall. Spacer means, which may be in the form of a raised portion formed integrally with the base wall of the housing, are used when a larger diameter globe is to be mounted.

Accordingly, it is an important object of the present invention to provide an improved lamp fixture which overcomes the disadvantages of the prior art.

Another important object of the present invention is to provide an improved lamp fixture, as described above, wherein two different size globes may be accommodated in a single fixture.

Still another object of the present invention is to provide an improved lamp fixture, as described above, wherein resilient spring clip means are utilized for releasably retaining different sized globes in a single fixture.

These and other objects, features and advantages of the invention will, in part, be pointed out with particularity and will, in part, become obvious from the following more detailed description of the invention, by way of example, taken in conjunction with the accompanying drawing, which forms an integral part thereof.

BRIEF DESCRIPTION OF THE DRAWING

In the various figures of the drawing, like reference characters designate like parts. In the drawing.

DESCRIPTION OF THE PREFERRED EMBODIMENTS

Figure 1:
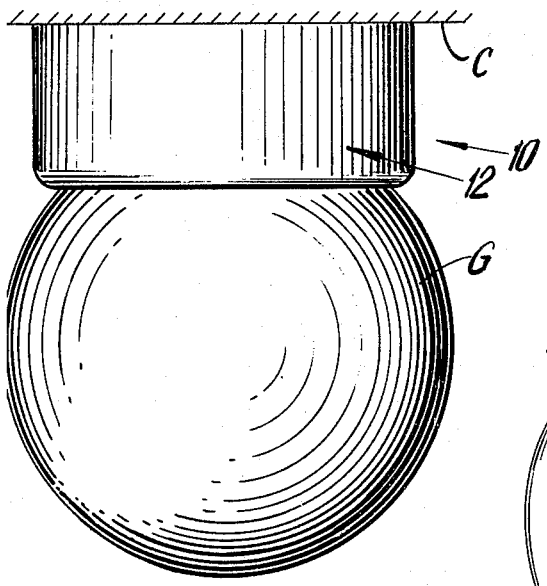
FIG. 1 is an elevational view of one embodiment of the present invention which is shown mounted on a ceiling, for example.
Figure 2:
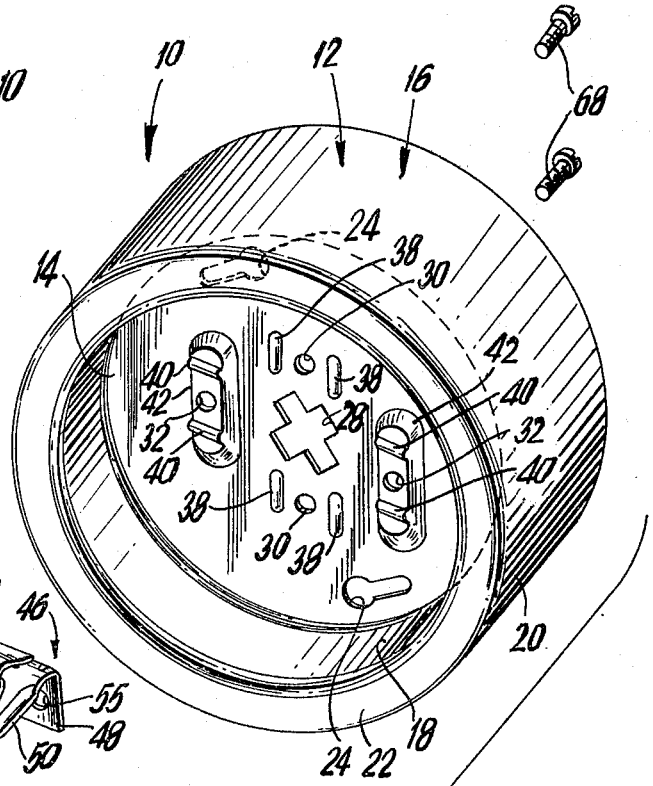
FIG. 2 is an exploded, perspective view of the embodiment of the present invention shown in FIG. 1.
Figure 2:
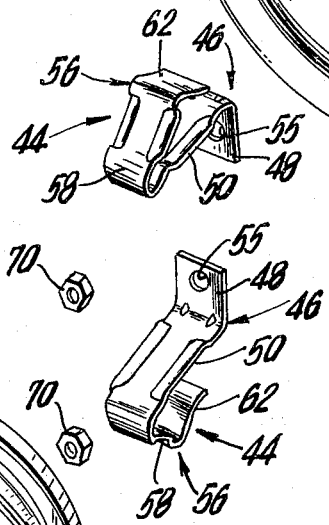
Figure 3:
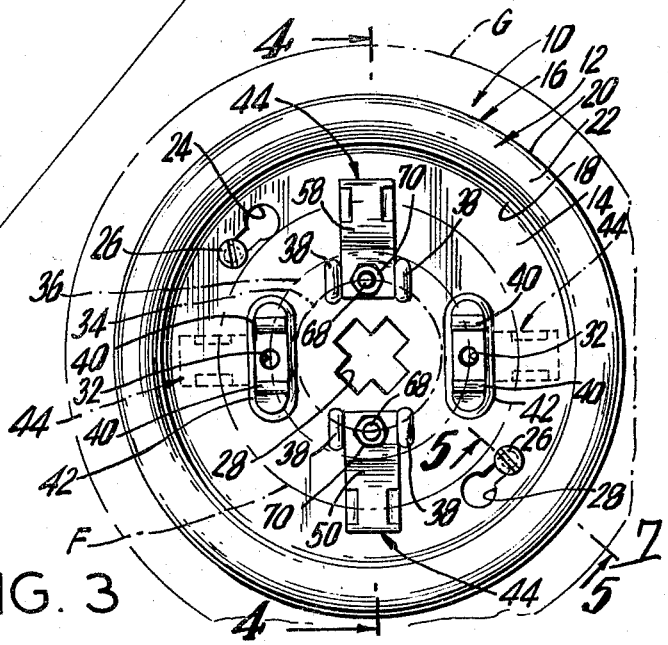
FIG. 3 is a bottom plan view of the lamp fixture comprising the present invention.

Referring now to FIGS. 1, 2 and 3, there is shown an improved lamp fixture 10 according to the present invention. The lamp fixture 10 includes a sheet metal housing generally designated by the reference character 12, which has a base wall 14 and a peripheral sidewall 16. As shown best in FIGS. 4–6, the base wall 14 is recessed and the peripheral side wall 16 is formed of inner and outer circular wall sections 18 and 20, respectively. The inner and outer wall sections 18 and 20 are joined to each other by a generous bight radius 22.

Referring specifically to FIGS. 2 and 3, it will be seen that the base wall 14 is provided with two diametrically opposed keyhole shaped slots 24 which are adapted to receive screws 26 in a conventional manner so that the housing 12 may be secured either to a ceiling C as shown in FIG. 1 or to a vertical wall and the like. In the usual manner the screws 26, which are affixed to a bracket (not shown) in either the ceiling or the wall are passed (enlarged head first) through the larger portions of the openings 24 and then the housing 12 is rotated so that the shank of the screws 26 occupy the elongated, narrow openings in the slots 24. The screws 26 may then be tightened so that the screw heads abut against the base wall 14 in order to secure the fixture 10. A central opening 28 is also provided in the base wall 14 of the housing 12 in order to accommodate the lamp socket and wiring in a conventional manner.

Still referring to FIGS. 2 and 3, it will be seen that two pairs of diametrically opposed holes 30 and 32 are formed in the base wall 14. The holes 30 are formed on a first, smaller diameter 34 and the holes 32 are formed on a second larger diameter 36 (FIG. 3). Straddling each of the holes 30 and 32 are locating means in the form of pairs of spaced apart ribs 38 and 40, respectively. The holes 32 and their respective ribs 40 are formed in spacer means 42 which are integral with the base wall 14 and are raised or spaced therefrom for a purpose to be described hereinafter.

It is noted, that the position of the lamp fixture 10 is reversed or upside-down in FIGS. 4–7 with respect to the globe to more clearly illustrate the parts thereof. However, it is understood that the lamp fixture 10 could be mounted in this position if desired.

Figure 4:
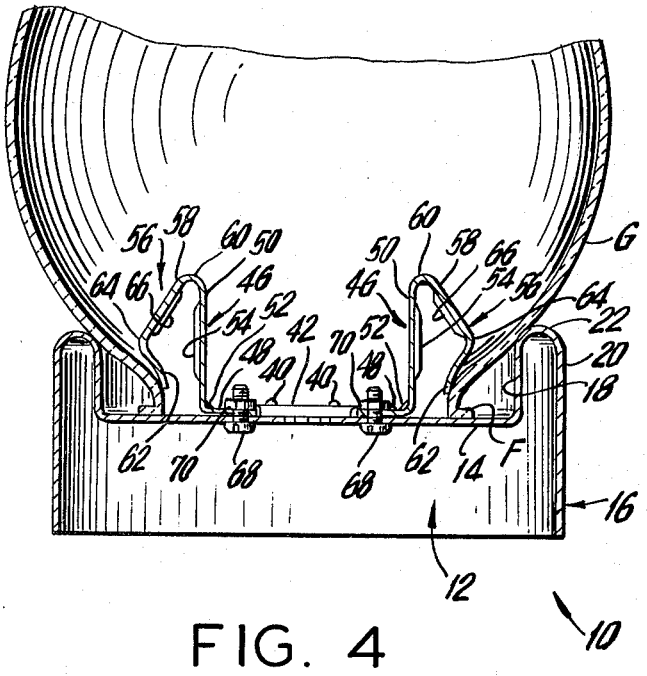
FIG. 4 is a fragmentary sectional elevational view taken along line 4—4 of FIG. 3, with the lamp fixture in a reverse position below the globe.
Figure 6:
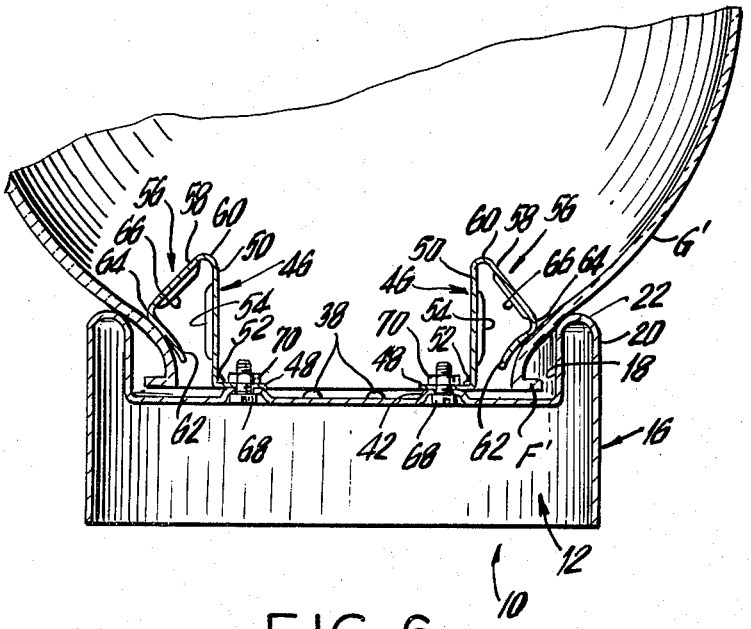
FIG. 6 is a fragmentary sectional elevational view similar to FIG. 4 illustrating the alternative arrangement of the resilient clip means comprising the present invention.

The resilient clip means comprising the present invention are generally designated by the reference character 44. Each clip means 44, as best seen in FIGS. 4 and 6, is comprised of a first, substantially L-shaped end 46 which includes a first leg 48 and a second leg 50. Gussets 52 are formed at the juncture of the first and second legs 48 and 50 in order to prevent relative flexing therebetween and a stiffening rib 54 is formed in the second leg 50. An opening 55 is also formed in the first leg 48.

Each spring clip 44 is further comprised of a second, substantially L-shaped end 56 having one leg 58 secured to the second leg 50 by means of a bight 60 and a second free leg 62 that is joined to the first leg 56 by another bight 64. A stiffening rib 66 is formed in the first leg 56. It will be appreciated from the foregoing that, because of the bights 60 and 64, bending or flexing can take place between the legs 50 and 56 and between the legs 56 and 62.

In the embodiment illustrated, the legs 48 of the spring clips 44 are secured to the base wall 14 by means of screws 68 that pass through the openings 56 and either pair of openings 30 or 32 which are registered with the openings 56. Nuts 70 may be used to secure the spring clips 44 in place or the screws 68 may be of the self-tapping type. The pairs of ribs 38 and 40 prevent rotation of the spring clips 44.

While two spring clips 44 have been illustrated, it will be understood that a greater number may also be used. Preferably, the spring clips 44, regardless of the number that are used, will be equally spaced apart in an angular direction. In addition, while screws 68 and nuts 70 have been illustrated as providing means for securing the spring clips 44 to the base wall 14, it will be understood that other forms of attachment may also be used. For example, tabs may be notched out by a stamping operation in order to releasably hold the legs 48 of the spring clips 44.

Figure 5:
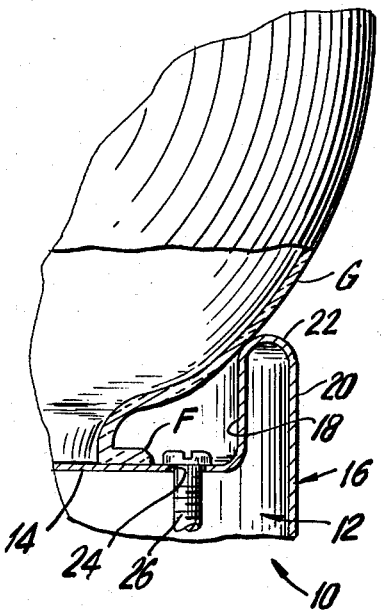
FIG. 5 is a fragmentary sectional elevational view taken along line 5—5 of FIG. 3, with the lamp fixture in the reverse position.
Figure 7:
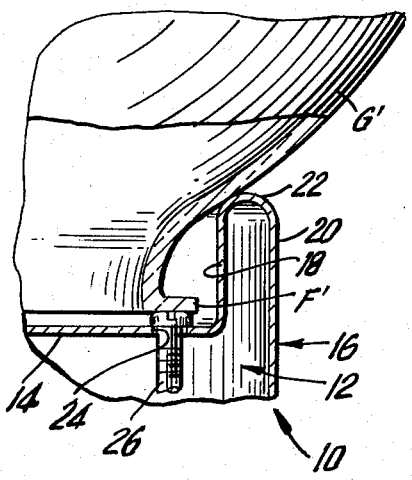
FIG. 7 is a fragmentary sectional elevational view similar to FIG. 5 illustrating the alternative arrangement.

By way of example, and without intending to be limiting, the openings 30 may be placed on a diameter of 1 11/32 inches in order to accommodate a 6 inch globe G. The openings 32 in the same fixture would then be placed on a 2 inch diameter in order to accommodate an 8 inch globe G′. When the 8 inch globe G′ is mounted, such as shown in FIGS. 6 and 7, the flange F′ thereof will be on the same diameter as the mounting screws 26. It is in order to provide clearance between the flange F′ and the head of the screw 26 that the spacer means 42 are provided. By way of contrast, the flange F of a 6 inch globe G will be radially inward of the heads of the screws 26 so that spacer means in the vicinity of the holes 30 are not required, as shown in FIG. 5.

By way of further example, and without intending to be limiting, the height of the side wall 16 may be approximately 2 1/16 inch while the diameter of the side wall 16 may be approximately 5 1/32 inch. The base wall 14 may be recessed approximately ⅞ inch below the bight 22 and the diameter of the inner wall portion 18 of the side wall 14 may be approximately 4¼ inch. The spacer means 42 may be 3/32 inch above the surface of the base wall 14.

From the foregoing, it will be appreciated that an improved lamp fixture for releasably holding different sized hollow globes has been provided. The globes are snapped into position and held by means of the resilient clip means which obviate the need for the prior art retaining screws. The clip means may be placed on a diameter that is selected for a given size globe with at least two different diameters being provided for the location of the clip means. The clip means may be readily changed from one diametric location to the other depending upon the size globe that is to be mounted.

The clip means resiliently engage the inner surface of the globe and impart a radially outwardly directed force in order to urge and hold the outer surface of the globe in contact with a portion of the housing. The clip means provide more than enough force to support the weight of the globe when the lamp fixture is mounted on the ceiling, the wall and the like.

There has been disclosed heretofore the best embodiment of the invention presently contemplated. However, it is to be understood that various changes and modifications may be made thereto without departing from the spirit of the invention.

What is claimed is:

1. A lamp fixture for releasably holding a hollow globe, said lamp fixture comprising:

a. a housing; and b. resilient clip means secured to a first portion of said housing in either one of at least two different locations for holding either one of at least two different sized globes in a fixed position relative to said housing, said clip means being positioned to engage a first portion of either of the globes and to urge a second portion of either of the globes into contact with a second portion of said housing, there being at least two of said clip means and said locations thereof being defined by diameters of different sizes, so that when a globe of a first size is to be held by said fixture, said clip means are positioned on one of said diameters; and when a globe of a different size is to be held by the same fixture, said clip means are positioned on another of said diameters.

2. A lamp fixture according to claim 1, wherein said clip means are diametrically opposed to each other when positioned at each said location.

3. A lamp fixture according to claim 1, wherein said housing includes a base wall defining said first housing portion and a peripheral side wall extending therefrom, said side wall defining said second housing portion, said clip means including a first, substantially L-shaped end having a first of two legs thereof mounted on said base wall and a second, substantially L-shaped end secured to the second leg of said first, substantially L-shaped end, a portion of said second, substantially L-shaped end being in contact with the inside surface of either of the globes and the outside surface of either of the globes being in contact with a portion of said peripheral side wall of said housing.

4. A lamp fixture according to claim 3, wherein said first and said second ends of said clip means are resiliently secured to each other at the junction thereof.

5. A lamp fixture according to claim 3, wherein said two legs of said second L-shaped end of said clip means are resiliently secured to each other at the junction thereof.

6. A lamp fixture according to claim 3, wherein there are further included spacer means positioned between said first end of said clip means and said base wall of said housing, said spacer means being located on the larger of said diameters.

7. A lamp fixture according to claim 6, wherein said spacer means are defined by raised portions of said base wall.

8. A lamp fixture according to claim 3, wherein there are further included two pair of locating means on each said diameter, said locating means of each said pair being diametrically opposed to each other, said first leg of said first end of said clip means being positioned between each said pair of said locating means to thereby prevent rotation of said clip means.

9. A lamp fixture according to claim 8, wherein each said locating means are defined by a pair of spaced apart ribs formed integrally with and raised from said base wall.

* * * * *